US009988163B2

(12) United States Patent
Chen

(10) Patent No.: US 9,988,163 B2
(45) Date of Patent: Jun. 5, 2018

(54) FIBER STRAP PACKING MACHINE

(71) Applicant: Hsiu-Man Yu Chen, Taichung (TW)

(72) Inventor: Hsiu-Man Yu Chen, Taichung (TW)

( * ) Notice: Subject to any disclaimer, the term of this patent is extended or adjusted under 35 U.S.C. 154(b) by 1044 days.

(21) Appl. No.: 14/288,876

(22) Filed: May 28, 2014

(65) Prior Publication Data

US 2015/0344160 A1 Dec. 3, 2015

(51) Int. Cl.

| | |
|---|---|
| ***B65B 13/18*** | (2006.01) |
| ***B65B 13/22*** | (2006.01) |
| ***B65B 13/02*** | (2006.01) |
| ***B65B 13/34*** | (2006.01) |

(52) U.S. Cl.

CPC ..... *B65B 13/188* (2013.01); *B65B 13/025* (2013.01); *B65B 13/22* (2013.01); *B65B 13/34* (2013.01)

(58) Field of Classification Search

CPC ..... B65B 13/025; B65B 13/188; B65B 13/22; B65B 13/34; B65B 13/345; B65B 13/16; B65B 13/305; B65B 13/327

USPC ..... 100/29, 32; 140/93.2, 123.6

See application file for complete search history.

(56) References Cited

U.S. PATENT DOCUMENTS

| | | | | |
|---|---|---|---|---|
| 2,969,221 | A * | 1/1961 | Harmes | B65B 13/025 254/218 |
| 3,129,728 | A * | 4/1964 | Sharko | B65B 13/025 140/123.6 |
| 4,252,158 | A * | 2/1981 | McDade | B60P 7/083 140/123.6 |
| 7,438,094 | B2 * | 10/2008 | Hillegonds | B21F 9/02 100/30 |
| 7,458,398 | B2 * | 12/2008 | Hillegonds | B21F 9/02 140/123.6 |
| 2004/0079436 | A1 * | 4/2004 | Hillegonds | B65B 13/027 140/123.6 |
| 2015/0210411 | A1 * | 7/2015 | Finzo | B65B 13/025 100/29 |

* cited by examiner

*Primary Examiner* — Jimmy T Nguyen
*Assistant Examiner* — Gregory Swiatocha
(74) *Attorney, Agent, or Firm* — Ming Chow; Sinorica, LLC

(57) ABSTRACT

A fiber strap packing machine includes a main body. One side of the main body is provided with a fastening device, a cutting device, and a strap pressing device. The fastening device includes a power unit, a tension adjustment unit, and a strap rolling unit. The power unit is connected with the tension adjustment unit and the strap rolling unit. When the strap rolling unit is tightened by a fiber strap, the power of the power unit will be transmitted to the tension adjustment unit through the fastening device. The tension adjustment unit stops the power to be transmitted to the strap rolling unit so as to automatically adjust the tightness of the fiber strap and prevent the tightening device from being damaged by the external force and the power.

8 Claims, 12 Drawing Sheets

FIBER STRAP PACKING MACHINE

BACKGROUND OF THE INVENTION

1. Field of the Invention

The present invention relates to a packing machine, and more particularly to a pneumatic packing machine used for fiber straps.

2. Description of the Prior Art

FIG. 1 is a perspective view of a conventional packing machine. The packing machine comprises a main body 1. One side of the main body is provided with a cutting device 2, a tightening device 3, and a pressing device 4 which are arranged from front to back in sequence. A press handle 5 is mounted on top of the main body 1. After an article is baled by a fiber strap, one end of the fiber strap is inserted into the bottom of the pressing device 4 and then pressed and secured thereat. The other end of the fiber strap is inserted through a strap inlet 6 of the cutting device 2 and into a groove 7 of the fastening device 3. Afterward, the press handle 5 is turned properly for the fiber strap to be rolled backward gradually by the tightening device. After tightening, the press handle 5 is pressed downward to activate the cutting device to cut the fiber strap, so that the article is baled completely.

However, the conventional packing machine has some shortcomings. First, the packing machine is operated manually. The operation is time-consuming. Besides, it needs more strength to tighten the fiber strap. The user will feel tired easily after a period of time. This lowers the packing efficiency. Particularly, for a transportation service that requires a lot of packing work, this situation will be more obvious. The time to transport goods may be delayed accordingly. Secondarily, the fiber strap is inserted through the fastening device 3 and rolled backward by the fastening device 3 to be tightened gradually. The way to tighten the fiber strap doesn't have a fool-proofing device. When in use, the tightening device 3 may be damaged easily by the counterforce of the fiber strap and the force applied by the user. Accordingly, the inventor of the present invention has devoted himself based on his many years of practical experiences to solve these problems.

SUMMARY OF THE INVENTION

The primary object of the present invention is to provide a fiber strap packing machine. By using high pressure gas as a power source, the fiber strap packing machine can fasten the fiber strap automatically, adjust the tightness of the fiber strap, and prevent the packing machine from being damaged.

In order to achieve the aforesaid object, the fiber strap packing machine of the present invention comprises a main body and a fastening device at one side of the main body. The fastening device comprises a power unit, a tension adjustment unit, and a strap rolling unit. The power unit is connected with the tension adjustment unit and the strap rolling unit. The tension adjustment unit comprises a fixing seat, an adjustment member, an elastic member, and a fastening member. The fixing seat is fixed to the main body. The adjustment member is connected with the power unit. The elastic member is disposed between the adjustment member and the fastening member. The fastening member is threadedly connected to the fixing seat. The elastic member has a prestressing force toward the adjustment member.

The power unit of the fiber strap packing machine of the present invention uses high pressure gas as the power source for the main body to fasten the fiber strap automatically to encircle an article to be baled. After that, the fiber strap is pulled to the strap rolling unit and the power unit is started. The fiber strap is rolled backward by the strap rolling unit to be tightened gradually. When the article is baled by the fiber strap overly, the power of the power unit will be transmitted to the tension adjustment unit by the fastening device for the adjustment member of the tension adjustment unit to be idle and push the elastic member to stop the power to be transmitted to the strap rolling unit, such that the power unit and the strap rolling unit of the fastening device can be protected.

DETAILED DESCRIPTION OF THE PREFERRED EMBODIMENTS

Embodiments of the present invention will now be described, by way of example only, with reference to the accompanying drawings.

Figure 1:
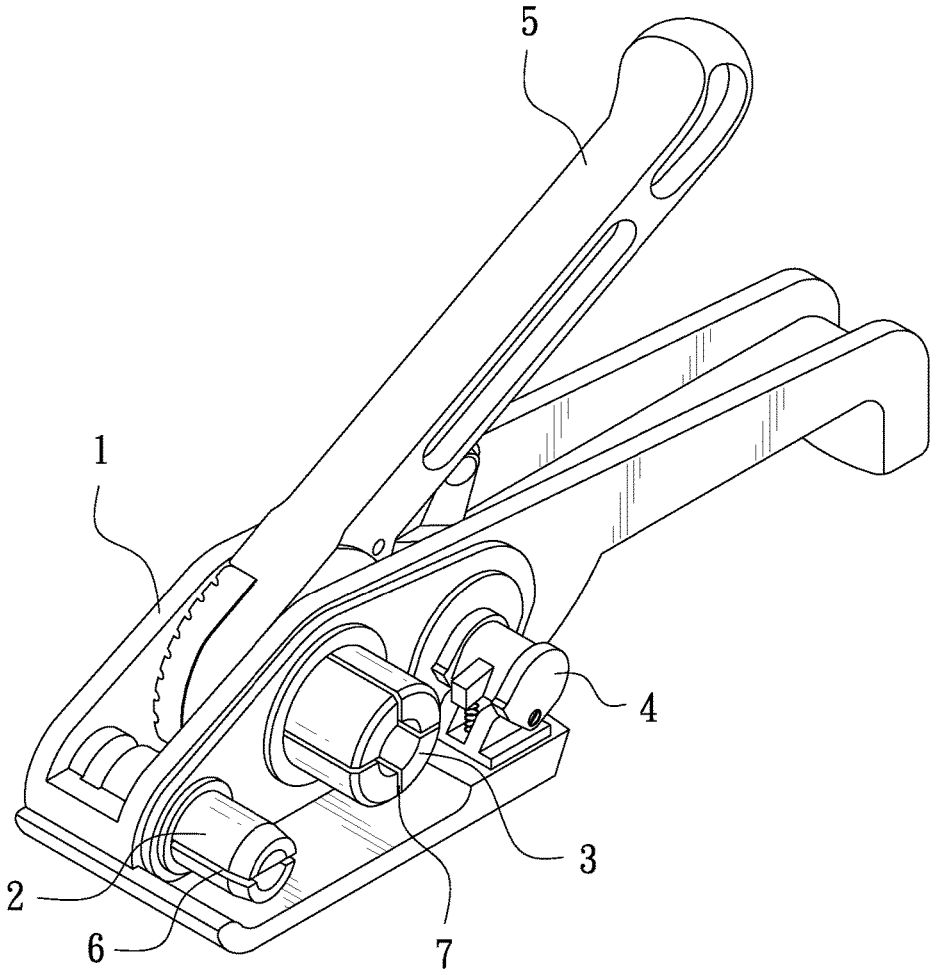
FIG. 1 PRIOR ART
FIG. 1 is a perspective view of a conventional packing machine.
Figure 2:
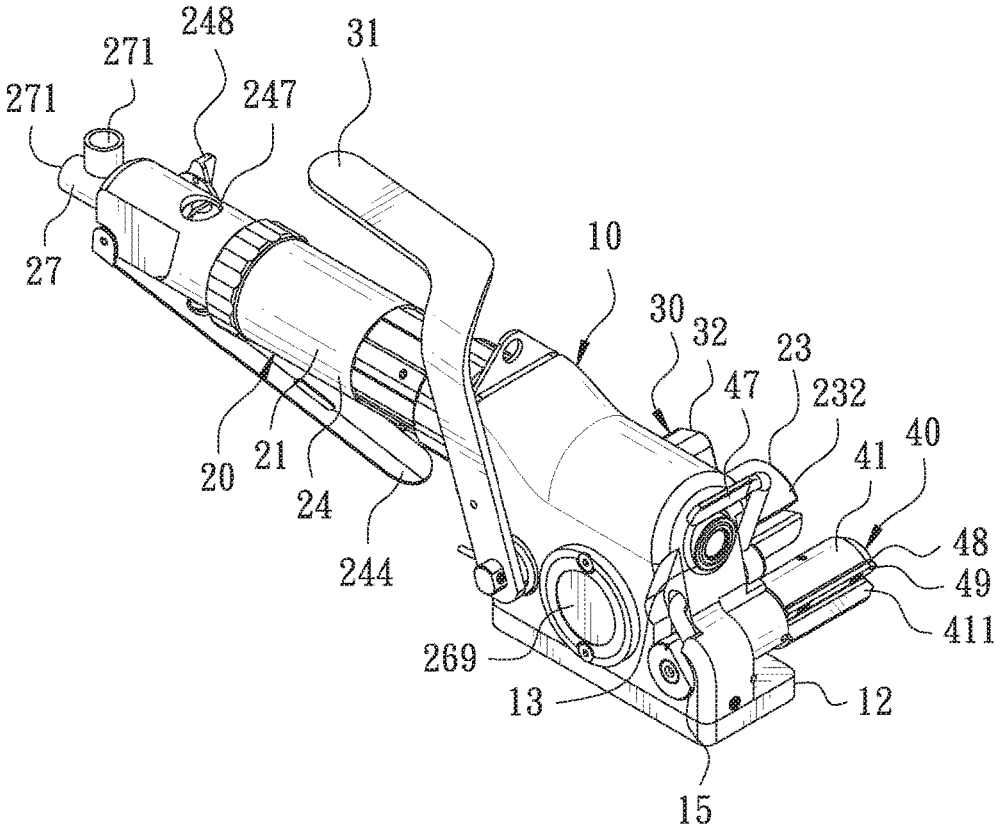
FIG. 2 is a perspective view according to a first embodiment of the present invention.
Figure 3:
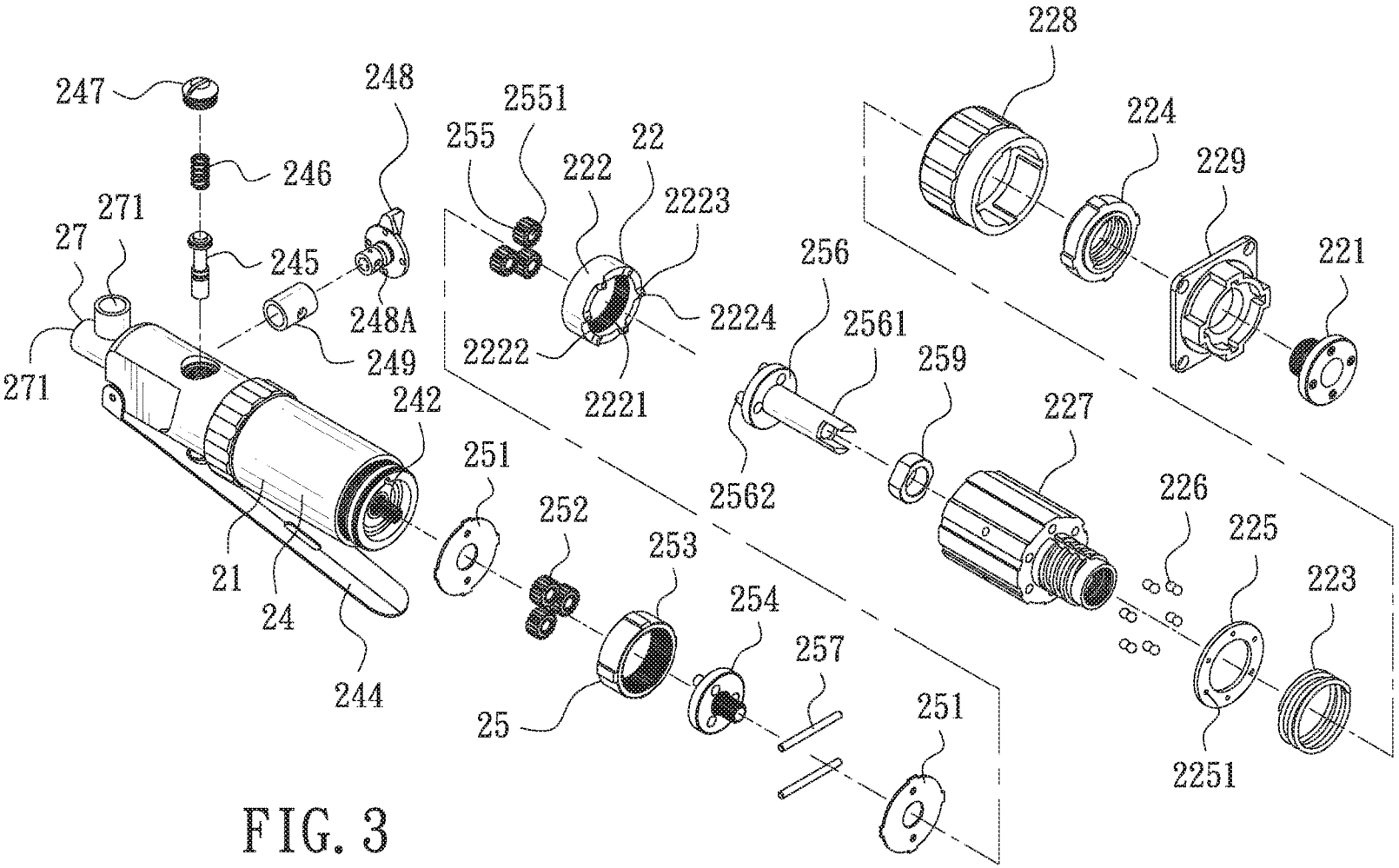
FIG. 3 is a partial exploded view according to the first embodiment of the present invention.

FIG. 2 is a perspective view according to a first embodiment of the present invention. FIG. 3 is a partial exploded view according to the first embodiment of the present invention. The present invention discloses a fiber strap packing machine. The fiber strap packing machine comprises a main body 10 and a fastening device 20.

Figure 6:
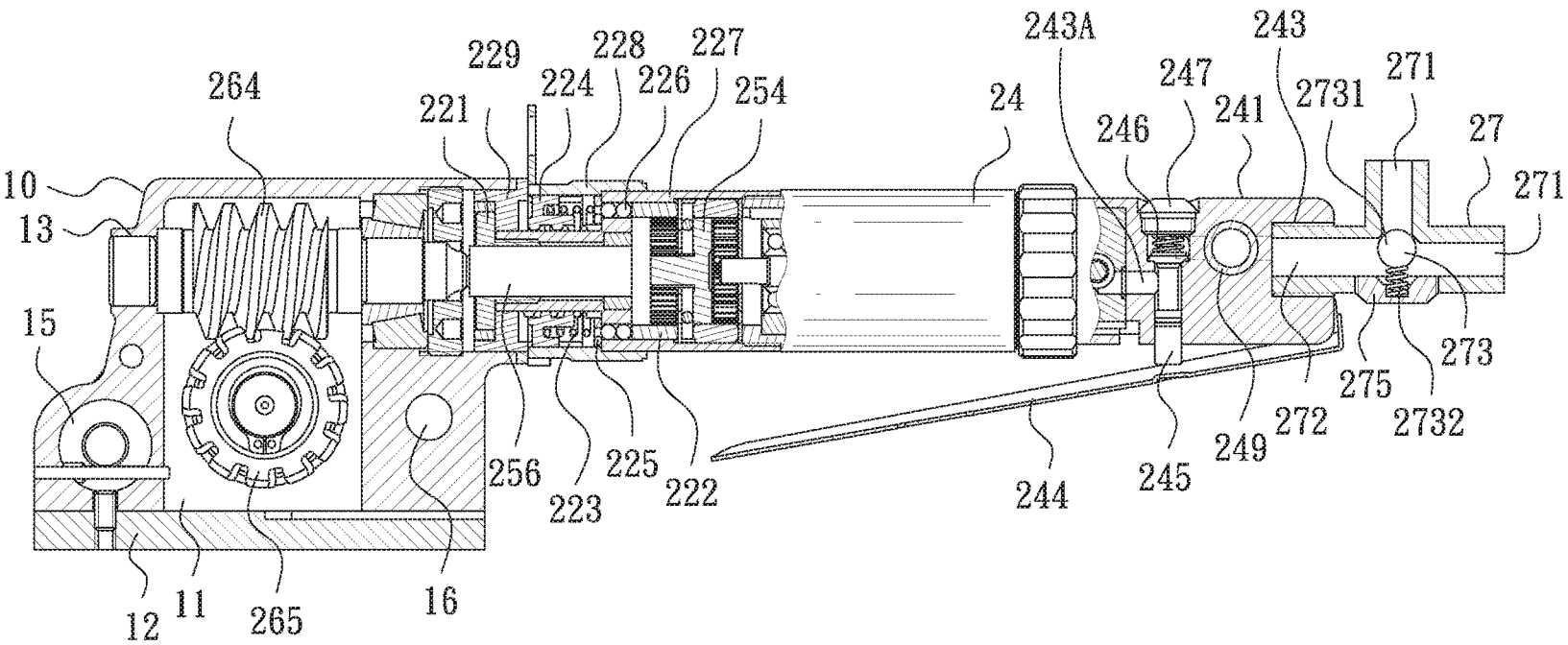
FIG. 6 is a lengthwise sectional view according the first embodiment of the present invention.

The main body 10 has a drive space 11 therein. The bottom of the main body 10 is provided with a base 12. The outer side of the main body 10 has a first connecting hole 13, a second connecting hole 14, a third connecting hole 15, and a fourth connecting hole 16. Referring to FIG. 6, the first connecting hole 13 is located above the second connecting hole 14, the third connecting hole 15, and the fourth connecting hole 16. The first connecting hole 13 and the second connecting hole 14 communicate with the drive space 11.

The fastening device 20 is disposed at one side of the main body 10 relative to the connecting hole 13. The fastening device 20 comprises a power unit 21, a tension adjustment unit 22, and a strap rolling unit 23. The power unit 21 is connected with the tension adjustment unit 22 and the strap rolling unit 23. The power unit 21 comprises a pneumatic motor 24, a drive gear assembly 25, and a worm bearing assembly 26. The pneumatic motor 24 has an input end 241 and an output end 242. The output end 242 is connected with the drive gear assembly 25. The drive gear assembly 25 comprises two spacers 251, an output gear 254 disposed between the two spacers 251, a toothed ring 253, and a plurality of first planetary gears 252. The first planetary gears 252 are disposed at one side of one of the two spacers 251. The first planetary gears 252 are connected with the output end 242. The first planetary gears 252 mesh with the toothed ring 253. The first planetary gears 252 are connected with the output gear 254. The other side of the output gear 254 is provided with the other spacer 251, and meshes with a plurality of second planetary gears 255. The second planetary gears 255 each have a connecting hole 2551. One side of an output disc 256 has a plurality of connecting posts 2562 relative to the connecting holes 2551 of the second planetary gears 255, so that the second planetary gears 255 are connected with one side of the output disc 256. Two parallel pins 257 are provided between the output gear 254 and the spacer 251. The other side of the output disc 256 is formed with a drive axle 2561. The drive axle 2561 is fitted with a copper axle sleeve 259.

Figure 4:
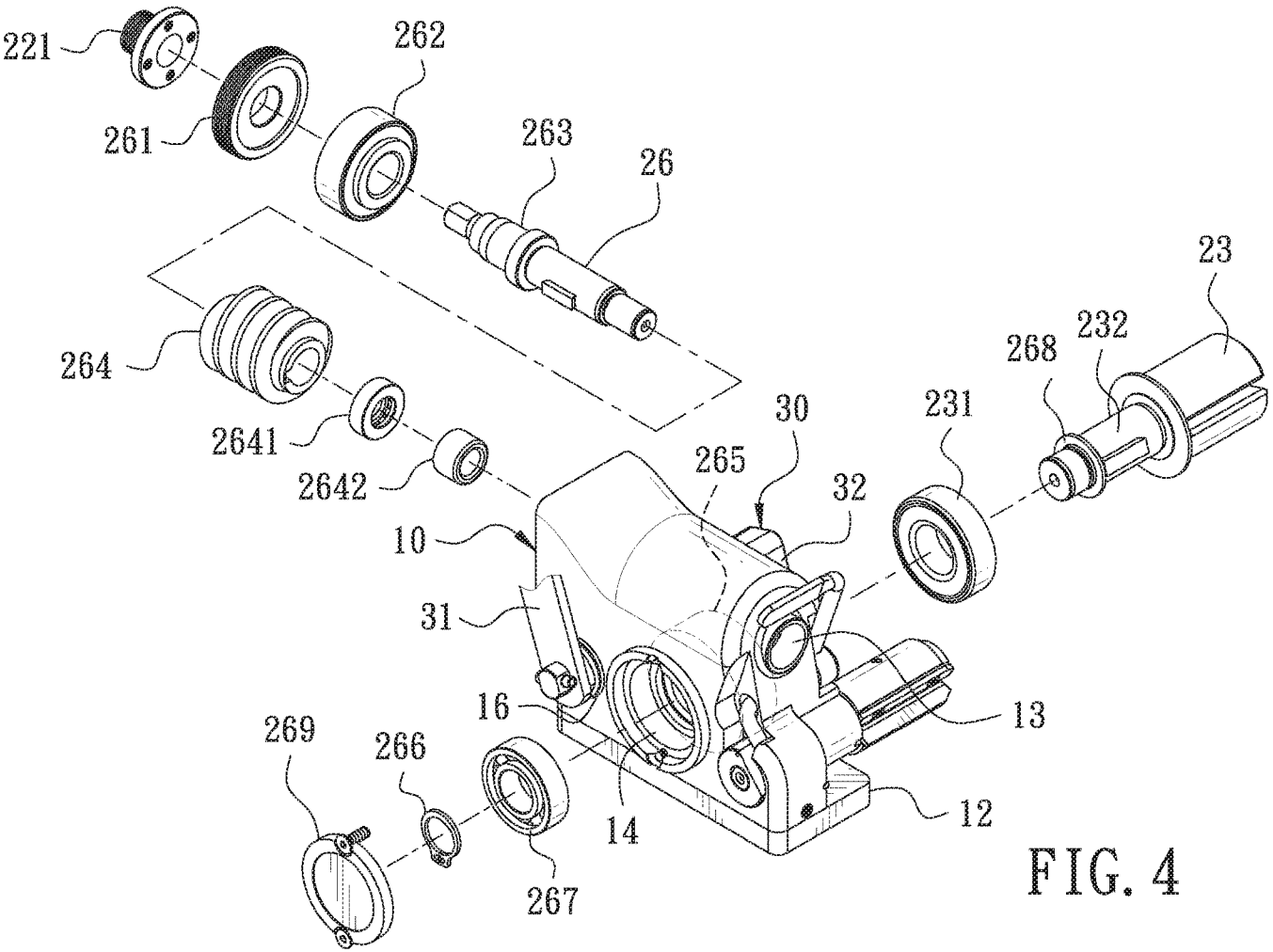
FIG. 4 is another partial exploded view according to the first embodiment of the present invention.

Referring to FIG. 2 and FIG. 6, in this embodiment of the present invention, the drive axle 2561 of the output disc 256 is connected with the tension adjustment unit 22. The tension adjustment unit 22 comprises a fixing seat 221, an adjustment member 222, an elastic member 223, and a fastening member 224. Wherein, the adjustment member 222 has an inner annular wall 2221. The inner annular wall 2221 has an inner toothed portion 2222 thereon. The inner toothed portion 2222 meshes with the second planetary gears 255. An adjustment spacer 225 is provided between the adjustment member 222 and the elastic member 223. A plurality of balls 226 are provided between the adjustment member 222 and the adjustment spacer 225. The adjustment member 222 has a plurality of protruding blocks 2223 relative to the balls 226. The protruding blocks 2223 are cone blocks. The peak of each of the protruding blocks 2223 is formed with a curved recess 2224. The adjustment spacer 225 has a plurality of fixing holes 2251 relative to the balls 226. The tension adjustment unit 22 and the drive gear assembly 25 are covered with a gear box casing 227. On end of the gear box casing 227 is threadedly connected to the output end 242 of the pneumatic motor 24, and the other end of the gear box casing 227 is fitted with an outer torsion ring 228. The outer torsion ring 228 is threadedly connected with the fastening member 224. One side of the fastening member 224 is provided with a connecting seat 229. The fixing seat 221 is disposed in the connecting seat 229. The fixing seat 221 is threadedly connected to the fastening member 224. Wherein, a drive shaft 258 protrudes out of the fixing seat 221, and is connected with the worm bearing assembly 26. The worm bearing assembly 26 is disposed in the drive space 11 of the main body 10. Referring to FIG. 4, the drive shaft 258 is connected with a worm shaft 263. The worm shaft 263 is sequentially fitted with a worm shaft lid 261 and a cone stop bearing 262 relative to one side of the drive shaft 258. The other end of the worm shaft 263 is connected with a worm 264, a roller bearing 2641, and a ball stop bearing 2642.

Figure 5:
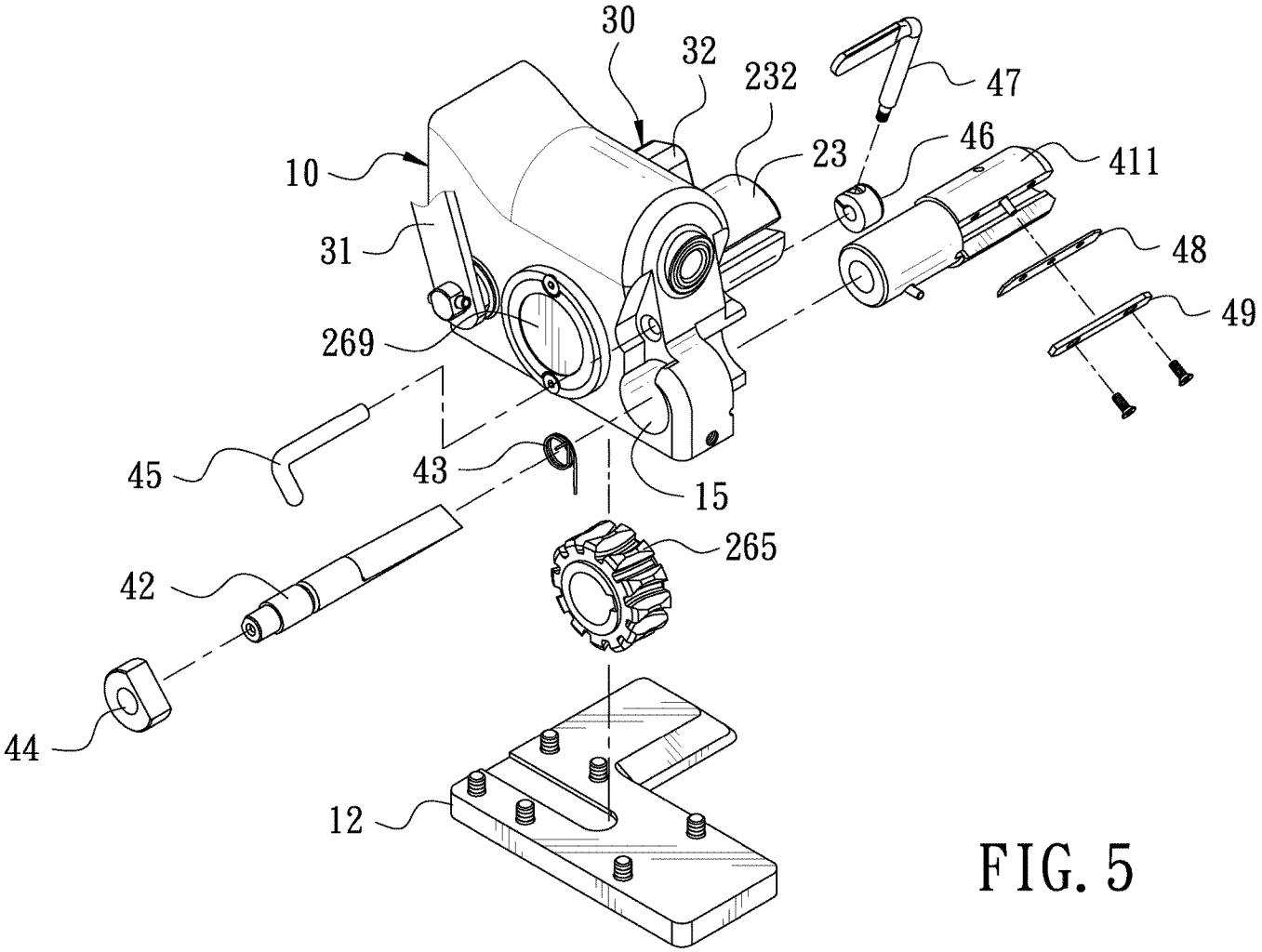
FIG. 5 is a further partial exploded view according to the first embodiment of the present invention.

Referring to FIG. 4 and FIG. 5, the circumferential side of the worm 264 is connected with a worm gear 265. One side of the worm gear 265 is connected with a C-shaped buckle 266 and provided with a worm gear ball bearing 267, a worm gear spacer 268, and a worm gear side lid 269 in sequence. The other side of the worm gear 265 is connected with the strap rolling unit 23. The strap rolling unit 23 comprises a ball bearing 231 and a spindle 232. The ball bearing 231 is fitted on the spindle 232. The spindle 232 corresponds to the second connecting hole 14, and is inserted through the worm gear 265.

Figure 9:
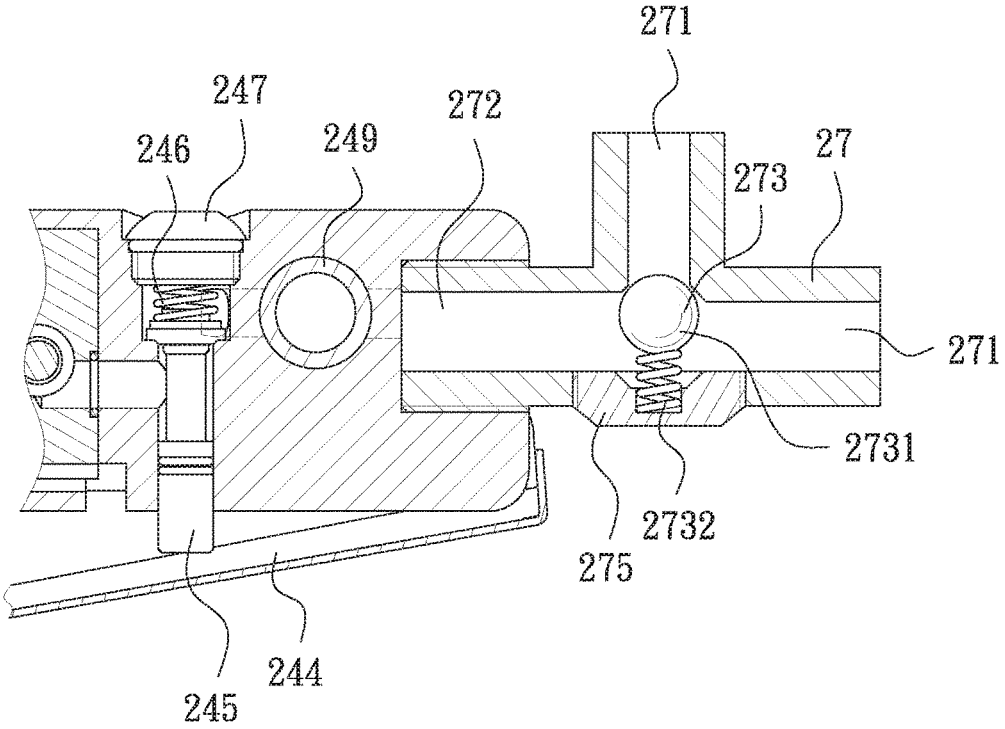
FIG. 9 is a partial sectional view according to the first embodiment of the present invention.

Referring to FIG. 3 and FIG. 6, the pneumatic motor 24 has an air inlet 243 at the input end 241. The air inlet 243 communicates with an air passage 243A. An air pressure control rod 245 and a flow control valve 248 are provided between the air inlet 243 and the air passage 243A. Wherein, the flow control valve 248 has a plurality of flow control through holes 248A in different sizes. The air inlet 243 communicates with the flow control through holes 248A. The pneumatic motor 24 is further pivotally connected with a press plate 244. The press plate 244 is adapted to be against one end of the air pressure control rod 245. The other end of the air pressure control rod 245 is provided with a spring 246 and a button 247. The spring 246 is located between the button 247 and the air pressure control rod 245. The flow control valve 248 is disposed close to one side of the air pressure control rod 245. A flow control copper sleeve 249 is fitted on the flow control valve 248. In this embodiment of the present invention, the input end 241 of the pneumatic motor 24 is further provided with a T-shaped pipe 27. The T-shaped pipe 27 communicates with the pneumatic motor 24. Referring to FIG. 9, the T-shaped pipe 27 communicates with the pneumatic motor 24. The T-shaped pipe 27 has two air inlets 271 and an air outlet 272. The air outlet 272 communicates with the air inlets 271. The interior of the T-shaped pipe 27 is provided with a commutating configuration 273 located at the junction of the air inlets 271. The commutating configuration 273 comprises a steel ball 2731, a spring 2732, and a cover 275. One end of the spring 2732 holds against the steel ball 2731, and the other end of the spring 2732 is connected with the cover 275. The cover 275 is fixed to the T-shaped pipe 27, such that the steel ball 2731 is able to seal one of the air inlets 271.

The fiber strap packing machine further comprises a strap pressing device 30 corresponding in position to the third connecting hole 15 of the main body 10. The strap pressing device 30 has a pressing member 31. The pressing member 31 is connected with a strap pressing member 32. The strap pressing member 32 is adjacent to one side of the spindle 232.

The fiber strap packing machine further comprises a cutting device 40 corresponding in position to the fourth connecting hole 16 of the main body 10. The cutting device 40 has a cutter pipe 41. A cutter shaft 42 is inserted in the cutter pipe 41. A torsion spring 43 and a cutter ring 44 are fitted on one end of the cutter shaft 42. One side of the cutter ring 44 is pressed by a cutter push rod 45. The other end of the cutter push rod 45 is fitted with a cutter push rod ring 46. The outer side of the cutter push rod ring 46 is connected with a press handle 47. The cutter pipe 41 is formed with two fixing blocks 411 opposite to one end of the cutter push rod ring 46. A strap cutting groove 412 is formed between the two fixing blocks 411. One side of one of the two fixing blocks 411 is threadedly connected with a blade 48 and a blade press plate 49 in sequence. The blade press plate 49 is stacked on the outer side of the blade 48.

Figure 10:
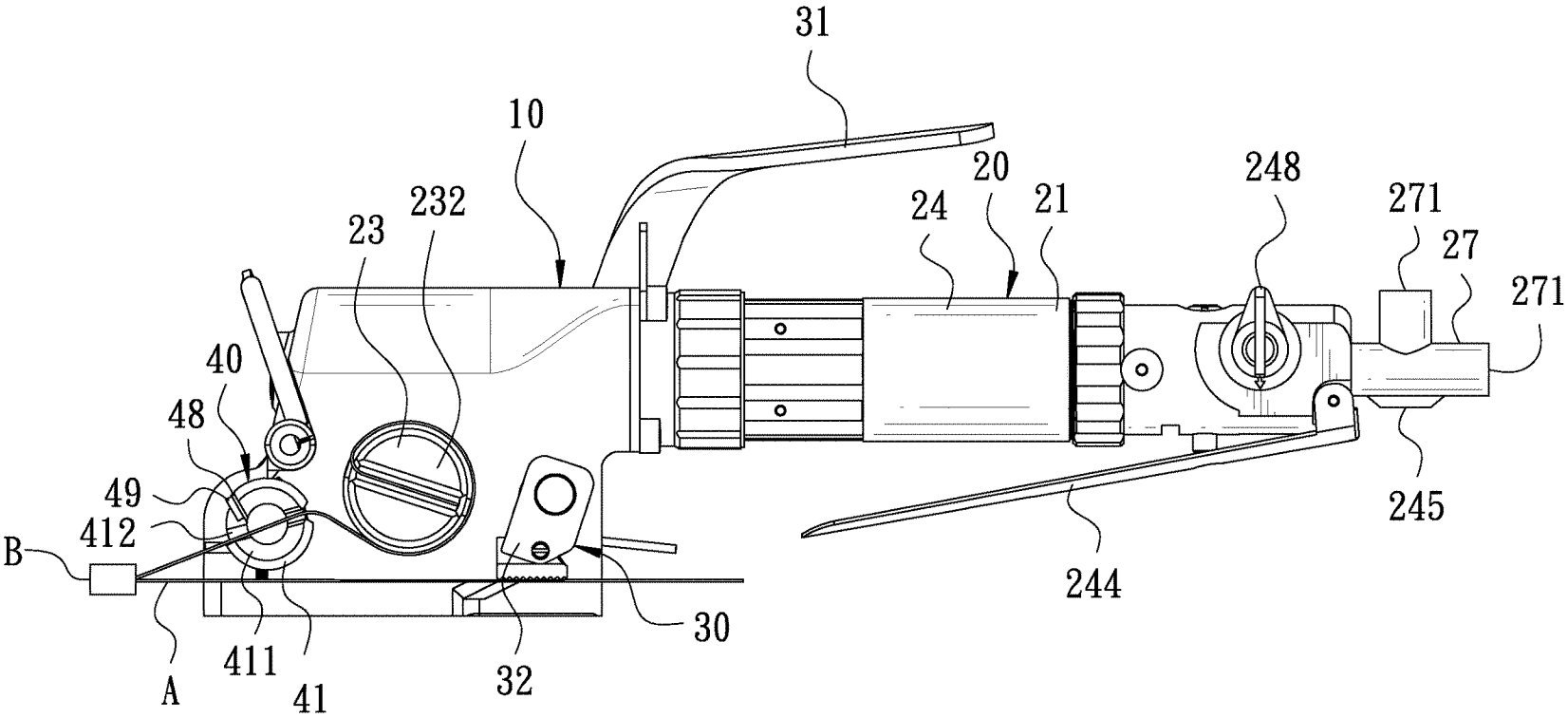
FIG. 10 is a schematic view of the first embodiment of the present invention when in use.

FIG. 10 is a schematic view of the first embodiment of the present invention when in use. When the fiber strap packing machine is used, a fiber strap A for packing is used to encircle an article to be baled. After that, one end of the fiber strap A is inserted through the strap pressing member 32 of the strap pressing device 30, and the pressing member 31 is pressed to link the strap pressing member 32 to press and secure the fiber strap A. After the other end of the fiber strap A is inserted through the strap cutting groove 412 of the cutting device 40 and the spindle 232 of the strap rolling unit 23, high pressure gas in inputted through one of the air inlets 241 of the T-shaped pipe 24. At this time, the user presses the press plate 244 for the high pressure gas to be inputted to the pneumatic motor 24 to drive the spindle 232 to turn, and the fiber strap A is tightened backward for a packing motion. When the fiber strap packing machine of the present invention makes the fiber strap A bind the article completely, a clamp member B is used to secure the fiber strap A. The press handle 47 of the cutting device 40 is pressed to link the cutter pipe 41 to turn so as to cut the fiber strap A, such that the fiber strap A is able to bale the article completely.

FIG. 6 is a lengthwise sectional view according to the first embodiment of the present invention. FIG. 10 is a schematic view of the first embodiment of the present invention when in use. During the process to bale the article, the fiber strap A is pulled to the strap rolling unit 23 and the press plate 244 is pressed to start the power unit 21. The fiber strap A is rolled backward by the strap rolling unit 23 to be tightened gradually. When the article is baled by the fiber strap A overly, the fiber strap A is applied with an external force to the spindle 232 of the strap rolling unit 23 to stop turning of the spindle 232.

Figure 7:
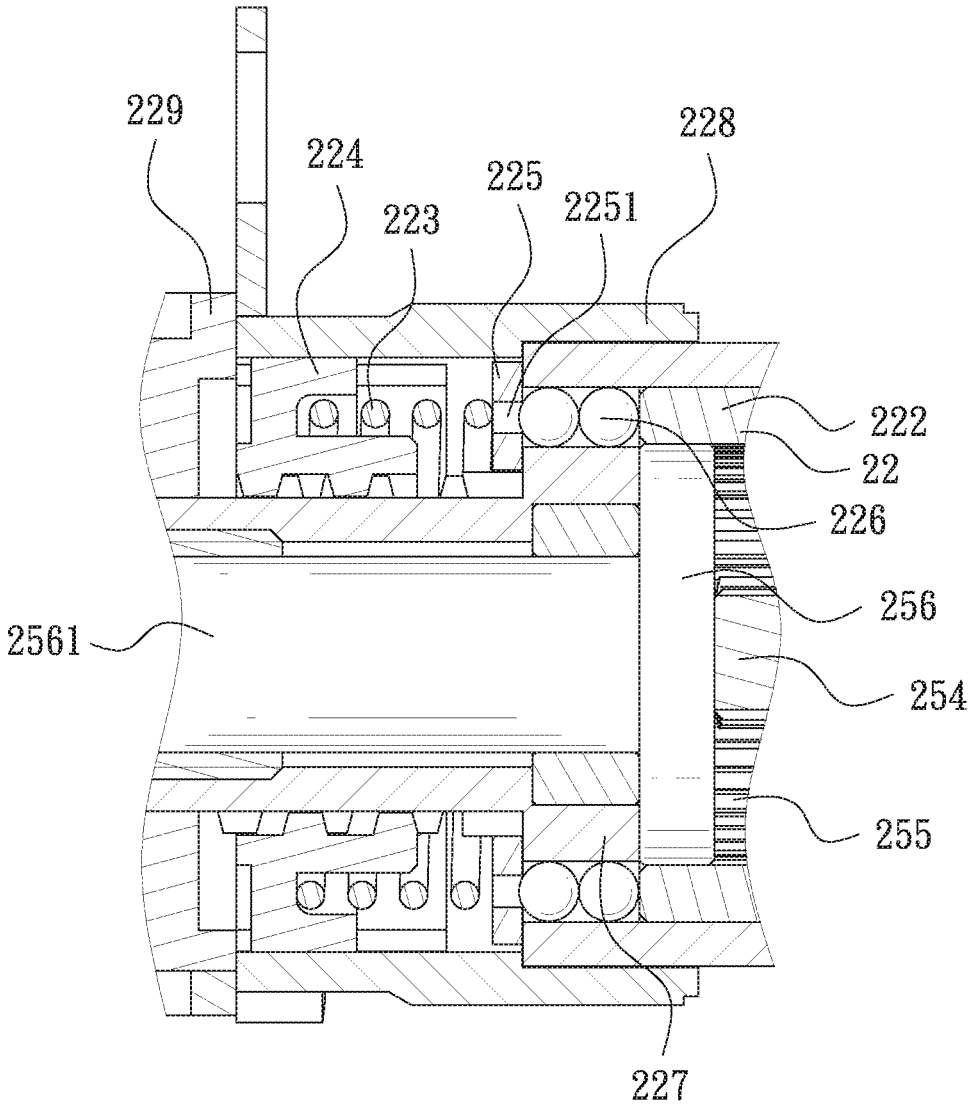
FIG. 7 is a schematic view showing operation of the first embodiment of the present invention.
Figure 8:
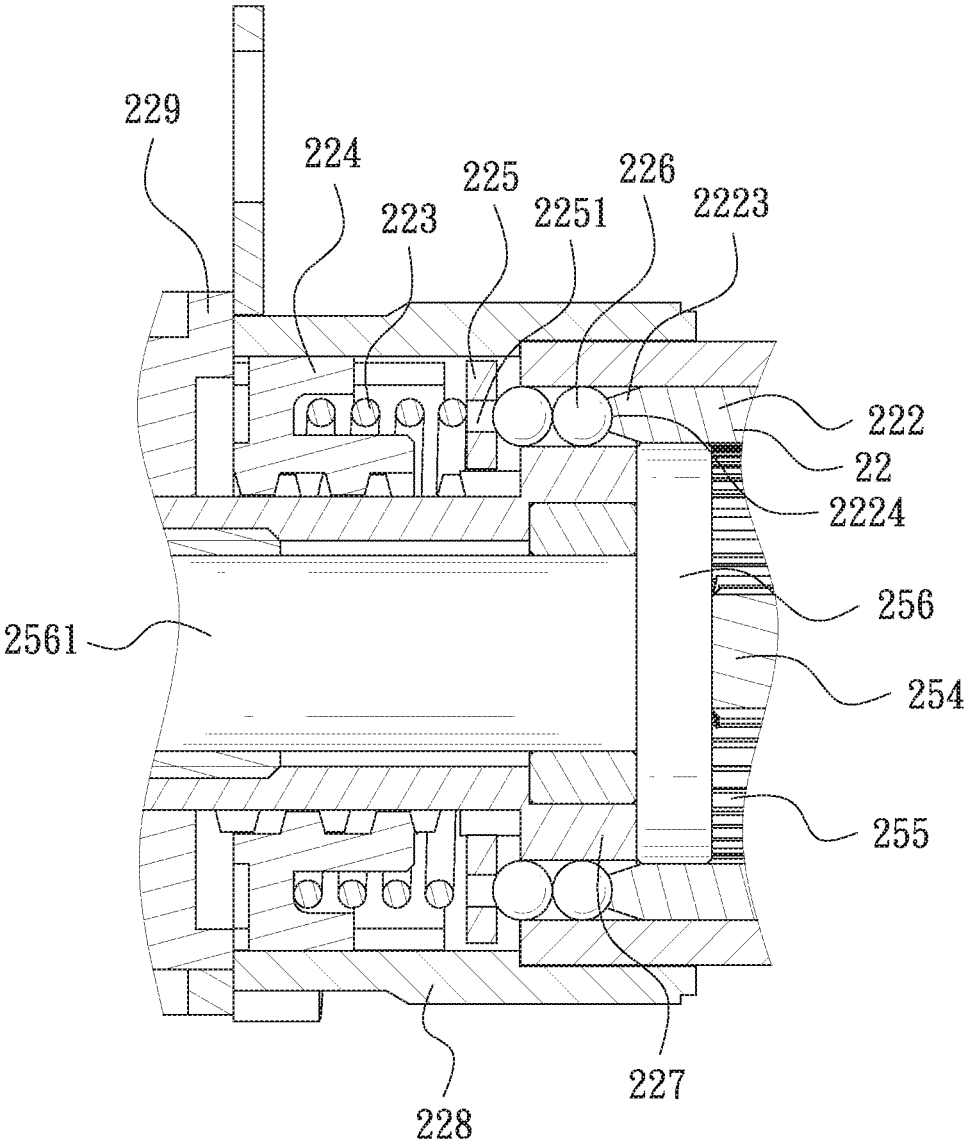
FIG. 8 is another schematic view showing operation of the first embodiment of the present invention.

FIG. 7 and FIG. 8 are schematic views showing operation of the first embodiment of the present invention. During the process to bale the article, the fastening force of the fiber strap A will generate a counterforce to the spindle 232. The counterforce will be transmitted to the worm gear 265, the worm 264, the output disc 256, and the second planetary gears 255 in sequence. The second planetary gears 255 mesh with the adjustment member 222 of the tension adjustment unit 22. The adjustment member 222 has a prestressing force to the elastic member 223. Therefore, in the beginning of baling, the counterforce is less than the prestressing force. The power unit 21 drives the worm bearing assembly 26 to turn the spindle 232 so as to tighten the fiber strap A gradually. This moment, the tension adjustment unit 22 is in a passive state. When the counterforce is greater than the prestressing force, the power of the power unit 21 will be transmitted to the tension adjustment unit 22. The adjustment member 222 is driven by the second planetary gears 255 to turn, such that the output disc 256 will generate a jump and the worm bearing assembly 26 connected with the spindle 232 will stop turning. Thereby, the fiber strap packing machine of the present invention can adjust the tension of the fiber strap A automatically so as to protect the power unit 21 and the strap rolling unit 23 of the fastening device 20. During turning, the protruding blocks 2223 are against the rollers 226, the adjustment spacer 225, and the elastic member 223. The rollers 226 respectively pass through the protruding blocks 2223 to bring a warning effect, so that the user can know the fiber strap A reaches the required tension. In the meanwhile, the prestressing force applied by the elastic member 223 to the adjustment member 222 can be adjusted through the fastening unit 224 so as to adjust the required tension of the fiber strap A.

FIG. 4 is a partial exploded view according to the first embodiment of the present invention. The blade 48 of the cutting device 40 is positioned by the blade press plate 49. The blade 48 is screwed to one side of the fixing block 411. When the blade 48 is damaged or blunt, the user can separate the blade 48 from the blade press plate 49 for replacement. Thus, the cutting device 40 of the present invention has a simple structure, and the blade 48 can be replaced conveniently.

FIG. 9 is a partial sectional view according to the first embodiment of the present invention. The T-shaped pipe 27 corresponds to the input end 241 of the pneumatic motor 24 and communicates with the pneumatic motor 24. The T-shaped pipe 27 has the air inlets 271 and the air outlet 272. The air inlets 271 communicate with the air outlet 272. The commutating configuration 273 is disposed in the T-shaped pipe 27. When the high pressure gas is inputted from the air inlet 271 opposite to the air outlet 272, the high pressure gas will pass through the spring 2732 and flow to the pneumatic motor 24. When the high pressure gas is inputted from the air inlet 271 at one side of the air outlet 272, the high pressure gas will push the steel ball 2731 to press the spring 2732 to open a flow passage so that the high pressure can flow to the air inlet 243 of the pneumatic motor 24. Thus, the air inlet 272 is selective according to the demand of the user. The commutating configuration 273 provides an automatic function to change the direction of air inlet so that it can be used conveniently.

Figure 11:
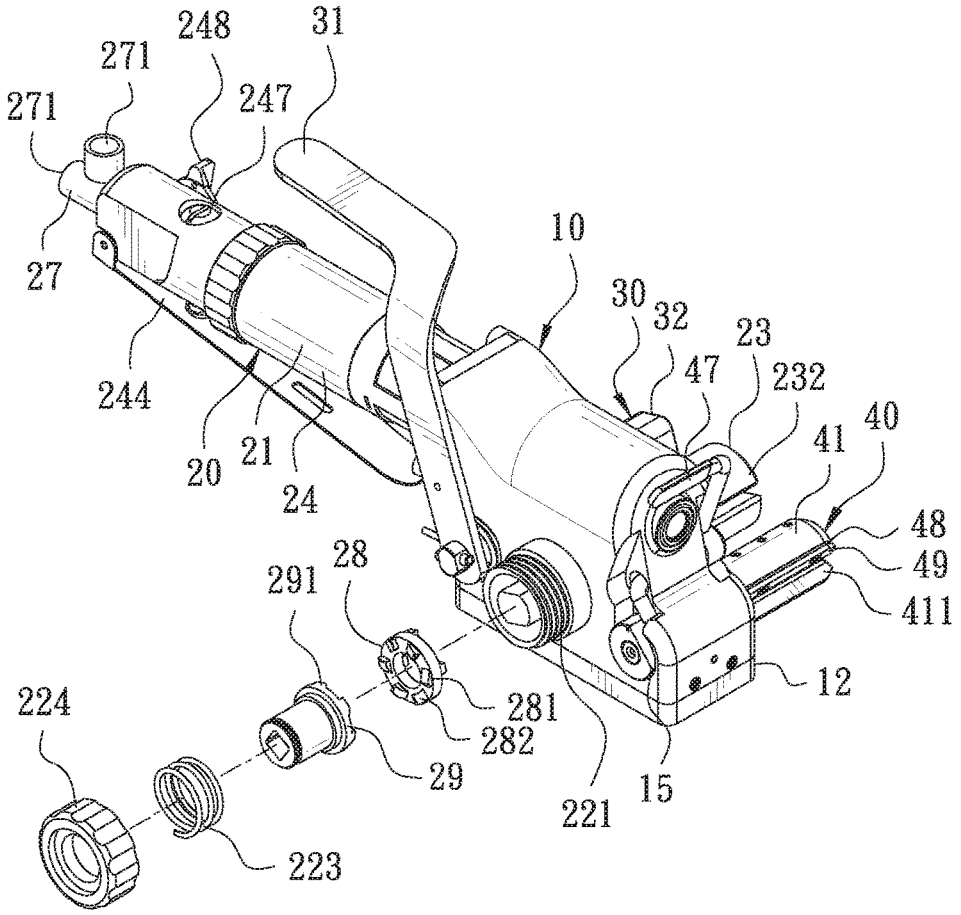
FIG. 11 is a partial exploded view according to a second embodiment of the present invention.
Figure 12:
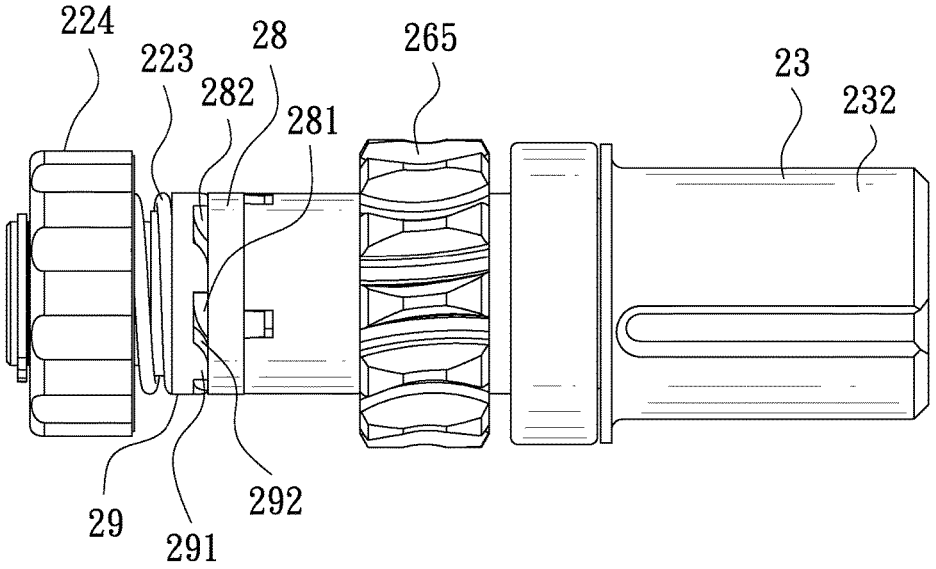
FIG. 12 is a partial perspective view according to the second embodiment of the present invention.

FIG. 11 is a partial exploded view according to a second embodiment of the present invention. FIG. 12 is a partial perspective view according to the second embodiment of the present invention. The second embodiment is substantially similar to the first embodiment with the exceptions described hereinafter. The tension adjustment unit 22 is provided with an output shaft. The output shaft is connected with the strap pressing device 30. In the second embodiment of the present invention, the output shaft is the spindle 232. The tension adjustment unit 22 is disposed between the worm gear 265 and the spindle 232. The adjustment member 222 of the tension adjustment unit 22 comprises a first adjustment member 28 and a second adjustment member 29. The first adjustment member 28 and the second adjustment member 29 mate with each other. The first adjustment member 28 is mounted to the worm gear 265. The elastic member 223 is disposed between the second adjustment member 29 and the fastening member 224. The fastening member 224 is threadedly connected to the fixing seat 221. The first adjustment member 28 has a plurality of first mating blocks 281 facing the second adjustment member 29. The first mating blocks 281 each have a first inclined surface 282. The second adjustment member 29 has a plurality of second mating blocks 291 relative to the first mating blocks 281. The second mating blocks 291 each have an inclined surface 292 relative to the first inclined surface 282. The second adjustment member 29 is connected with the spindle 232. In the second embodiment of the present invention, through the prestressing force of the tension adjustment unit 22, the output shaft will generate a jump for the fastening device 20 to stop turning.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A fiber strap packing machine comprising:

a main body;

a fastening device at one side of the main body;

the fastening device comprising a power unit, a tension adjustment unit and a strap rolling unit;

the power unit being connected with the tension adjustment unit and the strap rolling unit;

the tension adjustment unit comprising a fixing seat, an adjustment member, an elastic member and a fastening member;

the fixing seat being fixed to the main body;

the adjustment member being connected with the power unit;

the elastic member being disposed between the adjustment member and the fastening member;

the fastening member being threadedly connected to the fixing seat;

the elastic member having a prestressing force toward the adjustment member;

the power unit comprising an output gear, a plurality of planetary gears and an output disc;

the plurality of planetary gears meshing with the output gear;

the plurality of planetary gears each comprising a connecting hole;

the output disc comprising a plurality of connecting posts relative to the plurality of connecting holes of the plurality of planetary gears;

the adjustment member comprising an inner annular wall;

the inner annular wall comprising an inner toothed portion; and the inner toothed portion meshing with the plurality of planetary gears.

2. The fiber strap packing machine as claimed in claim 1, wherein an adjustment spacer is provided between the adjustment member and the elastic member, a plurality of balls are provided between the adjustment member and the adjustment spacer, the adjustment member has a plurality of protruding blocks relative to the balls, and the adjustment spacer has a plurality of fixing holes relative to the balls.

3. The fiber strap packing machine as claimed in claim 2, wherein the protruding blocks are cone blocks, and a peak of each of the protruding blocks is formed with a curved recess.

4. The fiber strap packing machine as claimed in claim 1, wherein the tension adjustment unit is disposed between a worm gear and a spindle, the tension adjustment unit comprises a first adjustment member and a second adjustment member, the first adjustment member and the second adjustment member mate with each other, the first adjustment member is mounted to the worm gear, and the elastic member is disposed between the second adjustment member and the fastening member.

5. The fiber strap packing machine as claimed in claim 4, wherein the first adjustment member has a plurality of first mating blocks, the first mating blocks each have a first inclined surface, the second adjustment member has a plurality of second mating blocks relative to the first mating blocks, the second mating blocks each have an inclined surface relative to the first inclined surface.

6. The fiber strap packing machine as claimed in claim 1, wherein the side of the main body is further provided with a cutting device, the cutting device comprises a cutter pipe, one end of the cutter pipe is connected with a press handle, another end of the cutter pipe is formed with two fixing blocks, a strap cutting groove is formed between the two fixing blocks, and one side of one of the two fixing blocks is provided with a blade.

7. The fiber strap packing machine as claimed in claim 1, wherein the power unit further comprises a pneumatic motor, the pneumatic motor has an input end and an output end, the output end is connected with the output gear, the pneumatic motor has an air inlet at the input end, the air inlet communicates with an air passage, an air pressure control rod and a flow control valve are provided between the air inlet and the air passage, the flow control valve has a plurality of flow control through holes in different sizes, the air inlet communicates with the flow control through holes, the pneumatic motor is further pivotally connected with a press plate, and the press plate is adapted to be against one end of the air pressure control rod.

8. The fiber strap packing machine as claimed in claim 7, wherein the input end of the pneumatic motor is further provided with a T-shaped pipe, the T-shaped pipe has an air outlet and two air inlets, the air outlet of the T-shaped pipe communicates with the air inlet of the pneumatic motor, the air outlet communicates with the air inlets, an interior of the T-shaped pipe is provided with a commutating configuration located at the junction of the air inlets, the commutating configuration comprises a steel ball, a spring, and a cover, one end of the spring holds against the steel ball, another end of the spring is connected with the cover, the cover is fixed to the T-shaped pipe, and the steel ball is able to seal one of the air inlets.

* * * * *